US005224834A

United States Patent [19]

Westerman et al.

[11] Patent Number: 5,224,834

[45] Date of Patent: Jul. 6, 1993

[54] PUMP-OFF CONTROL BY INTEGRATING A PORTION OF THE AREA OF A DYNAGRAPH

[75] Inventors: G. Wayne Westerman; Richard C. Montgomery, both of Midland, Tex.

[73] Assignee: EVI-Highland Pump Company, Inc., Odessa, Tex.

[21] Appl. No.: 813,098

[22] Filed: Dec. 24, 1991

[51] Int. Cl.[5] ..... F04B 49/06; F04B 49/02

[52] U.S. Cl. ..... 417/12; 417/18; 417/45; 417/53; 73/151

[58] Field of Search ..... 417/12, 18, 44, 45, 417/53; 73/151

[56] References Cited

U.S. PATENT DOCUMENTS 3,951,209 4/1976 Gibbs .
4,015,469 4/1977 Womack et al. .
4,034,808 7/1977 Patterson ..... 73/151
4,286,925 9/1981 Standish .
4,302,157 11/1981 Welton et al. .
4,487,061 12/1984 McTamaney et al. .
4,583,915 4/1986 Montgomery et al. .
4,594,665 6/1986 Chandra et al. ..... 417/18
4,973,226 11/1990 McKee ..... 417/18
5,006,044 4/1991 Walker et al. .

OTHER PUBLICATIONS

Protter et al., Calculus with Analytic Geometry, Apr. 1966, p. 238.
End Devices, Inc., Technical Data Sheet for Model 107DC device, Aug. 1978.
End Devices, Inc., Technical Notes for 500CS Beam Pump Controller, 129 DC device, Jan. 1981.

*Primary Examiner*—Richard A. Bertsch
*Assistant Examiner*—David W. Scheuermann
*Attorney, Agent, or Firm*—Steven G. Lisa

[57] ABSTRACT

New apparatus and methods are disclosed for controlling the operation of a rod-pumped oil well. The load on and position of the rod string are measured, an integration calculation related to the work done during a portion of the downstroke is performed, and the result is compared to a reference value, to detect a pumped-off condition in the well.

24 Claims, 3 Drawing Sheets

PUMP-OFF CONTROL BY INTEGRATING A PORTION OF THE AREA OF A DYNAGRAPH

BACKGROUND OF THE INVENTION

This invention relates to a system for determining the operating characteristics of a rod-pumped oil well and making automatic control decisions based on those determinations. Previous methods for detection and control of a condition known as "pump off" have evaluated data on a dynagraph, which displays measured polished rod load and measured or calculated polished rod position. Some prior systems, such as U.S. Pat. No. 4,286,925 to Standish, test for pump-off by determining whether the load at a particular point in the downstroke exceeds a preset or user-adjustable limit. Other systems have measured the area within the dynagraph for one full stroke (called a card), which represents work done by the pump, and compared that area against a limit or a "test card." U.S. Pat. No. 3,951,209 to Gibbs, for example, discloses a method of integrating the entire area within a dynagraph. U.S. Pat. No. 4,015,469 to Womack discloses a method of integrating equal portions of the upstroke and downstroke. End Devices, Inc., in its device known as the Model 107DC, disclosed a method of integrating the lower half of the dynagraph, i.e., the downstroke. Our U.S. Pat. No. 4,583,915 discloses a method of integrating a portion of the area below the dynagraph, i.e., the space between measured load and minimum load during a selected time period.

Each of those methods share the shortcomings that they are difficult to adjust and sometimes falsely detect pump-off when the well is in fact full. For example, when a well is shut down for a long period of time, such as for service work, the fluid level may rise in the annuls. That rise in fluid level reduces the hydrostatic head required to lift the fluid to the surface, just as if the well were shallower. When the pump is restarted, therefore, it needs to do less work, and the area inside the dynagraph may be reduced to the point that pump-off will be detected, even though the pump is full. U.S. Pat. No. 4,302,157, issued to Welton, et al., teaches a method for preventing false pump-off detection in which pump-off is recognized only after the pump first operates normally with a full pump. However, the method in that patent is complex and uses a simplistic "rule of thumb," rather than a highly discriminating test. All of the patents cited above are incorporated herein by reference.

The present invention provides an improved system for controlling a well and detecting pump-off.

SUMMARY OF THE INVENTION

It is therefore an object of the invention to provide a superior system and method for pump-off detection and control.

It is another object of the invention to provide a system and method for pump-off detection and control that will not detect pump-off falsely from high fluid level in the well.

It is another object of the invention to provide a system and method for pump-off detection and control that will not detect pump-off falsely from load excursions in the early part of the downstroke.

It is another object of the invention to provide improved systems and methods for pump-off detection and control which are based on integrating a selected portion of the area within a dynagraph, which allow for accurate selection of control parameters and which provides for consistent detection of pump-off under varying conditions.

It is another object of the invention to permit automatic adjustment of the conditions for pump-off detection.

Generally, the above and other objectives are achieved in an apparatus for controlling a well pumping system of the type in which a prime mover, or motor, is connected by a sucker-rod string to a reciprocated underground pump. The apparatus includes a load measuring device which determines the varying load on the sucker-rod string as the pump is reciprocated through its pumping cycle. A position measuring device determines the position values corresponding to the load values as the sucker-rod string is reciprocated through its pumping cycle. The controller includes means for the user to set an integration load reference value. Alternatively, the controller can automatically calculate the load reference value. The controller also provides means for allowing the user to set an end integration position reference value in the downstroke of the pumping cycle. Again, this value can be computed automatically. The load reference value, end integration position value, and actual determined load and position values set the integration area. In other words, the controller is programmed to integrate at least a portion of the area bounded by the integration load reference value, the end integration position reference value, and the curve formed by the determined load and position values. The controller also includes means for setting an area reference value against which the calculated value is tested. A comparison means is employed for comparing the integrated area to the area reference value. The controller alters the operating parameters of the well system based on the comparison of the integrated area to the area reference value. For example, if the calculated area is less than the area reference value, pump-off is detected and the well can be shut off for some predetermined time.

The above and other objects are also achieved in a method for controlling a well pumping system having a prime mover connected by a sucker-rod string to a reciprocated subterranean pump. In accordance with the method, at a series of times as the pump is reciprocated through its pumping cycle, a signal is generated which is proportional to the relative load on the sucker-rod string. A signal proportional to the position of the sucker-rod string in the pumping cycle is also generated contemporaneous with the load signal. A load reference value is set to indicate where in the stroke integration will begin. A position reference in the downstroke of the pumping cycle is also set, to indicate where integration will end. The controller integrates at least a portion of the area bounded by the load reference value, position reference value and the actual load and position values determined from the generated signals. An area reference value is predeterminately set at an acceptable test level. The controller compares the integrated area to the area reference value. Depending on the outcome of the comparison, the controller alters the operating parameters of the well system based on comparison.

Other aspects of the invention will be appreciated by those skilled in the art after a reading of the detailed disclosure of the present invention, below.

DESCRIPTION OF THE DRAWINGS

The novel features of this invention are described with particularity in the claims. The invention, together with its objects and advantages, are better understood after referring to the following descriptions and accompanying figures. Throughout the figures, the same reference numerals refer to the same elements.

DETAILED DESCRIPTION

Figure 1:
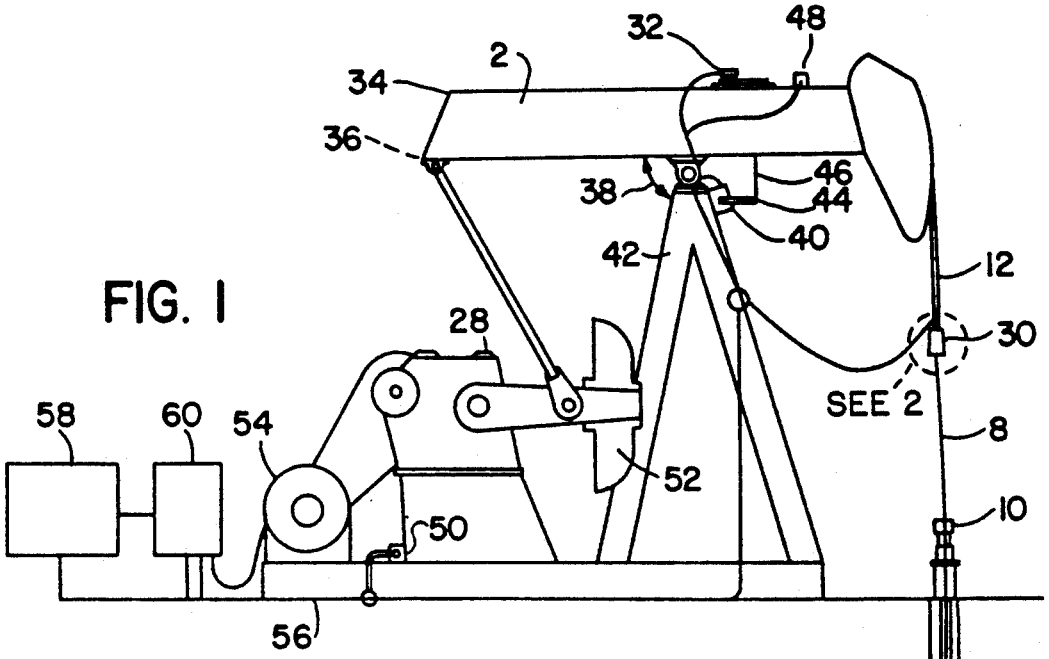
FIG. 1 shows a cross-section of the pumping equipment, both at the surface and downhole.
Figure 2:
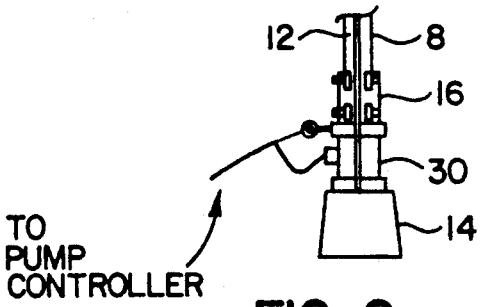
FIG. 2 shows a close-up view of a polished-rod load transducer.

Shown in FIG. 1 is an overview of a typical oil well and pumping unit 2. It is common practice to employ a series of interconnected rods, called sucker rods, comprising the rod string 4, for coupling pumping unit 2 to subsurface pump 6. The uppermost rod, generally referred to as the polished rod 8, passes through stuffing box 10, allowing the rod string to move up and down in the well without leaking well fluid. Referring to FIG. 2, the rod string is suspended from pumping unit bridle 12 on carrier bar 14 by means of polished rod clamp 16.

Figure 4:
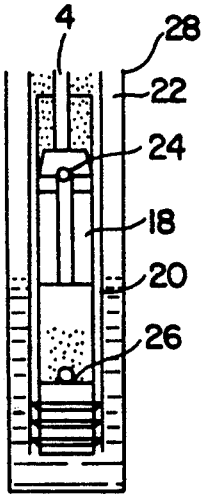
FIG. 4 shows a close-up view of a downhole pump, shown in a pumped-off condition.

Referring to FIG. 4, rod string 4 connects the pumping unit to plunger 18 of the pump, which is moved up and down in barrel 20 by the reciprocating motion of rod string 4. On the upstroke, the fluid (shaded) in tubing 22 is raised by the pump, and all of the fluid load is supported by plunger 18 and travelling valve 24. On the down-stroke, plunger 18 moves downward in pump barrel 20, which is filled with liquid. The pressure of the fluid in barrel 20 causes the ball of the travelling valve 24 to open and allows plunger 18 to travel downward through the liquid in pump barrel 20. With travelling valve 24 open, the fluid load is transferred to standing valve 26 and thus to tubing 22.

On the upstroke, normally, hydrostatic pressure of the fluid in the annuls between tubing 22 and casing 28 causes fluid to flow through standing valve 26 into pump barrel 20, which has been evacuated by the rising plunger 18. When the hydrostatic head of the fluid level in the annuls between casing 28 and tubing 22 is reduced to below a critical pump-intake pressure, however, the subsurface pump will cavitate due to incomplete filling, creating a condition commonly called "pump off." Due to the incomplete filling of pump 6, vapor is present in the portion of pump barrel 20 immediately below plunger 18, illustrated by shading in FIG. 4. The pressure from that vapor is insufficient to cause travelling valve 24 to open, and the load does not transfer from rod string 4 to tubing 22 until plunger 18 strikes the substance vapor-liquid interface in pump barrel 20, causing a rapid transfer of fluid load and kinetic energy from rod string 4 to tubing 22, commonly called "fluid pound." Fluid pound associated with pump-off can cause damage to the pumping equipment, particularly rod string 4, tubing 22, and pump barrel 20. The magnitude of the fluid pound is proportional to (1) the sum of the buoyant weight of rod string 4 and the fluid, and (2) the square of the velocity of plunger 18 when it strikes the fluid-vapor interface. Because the motion of conventional pumping units is generally sinusoidal, the velocity increases from zero at the top of the pumping stroke to a maximum near the middle of the downstroke. It is therefore desirable to detect accurately the occurrence of pump-off early in the downstroke and to stop the operation of the well until fluid can rise in the annuls between casing 28 and tubing 22 to produce sufficient hydrostatic head to fill pump barrel 20.

To detect pump-off in this manner, it is necessary to obtain measurements of load and position over time. A number of known techniques for making such measurements may be used for that application. For example, U.S. Pat. No. 4,143,546, issued to Wiener, and U.S. Pat. No. 3,457,781, issued to Elliott, each disclose at least one type of load-measurement technique and one type of position-measurement technique, and are incorporated herein by reference. It is also possible to convert from data representing polished-rod (surface) load and position to downhole data, using techniques such as that disclosed in our co-pending application, Ser. No. 07/773,696, which is incorporated herein by reference.

For example, referring again to FIGS. 1 and 2 of the present application, a strain gauge load transducer 30 may be inserted between carrier bar 14 and polished-rod clamp 16, which thereby carries all of the rod load. The electrical output from such a polished-rod-mounted load transducer 30 is directly proportional to the load on polished rod 8. See, e.g., U.S. Pat. No. 4,363,605, issued to Mills, incorporated herein by reference.

Figure 3:
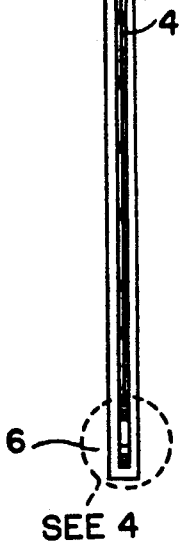
FIG. 3 shows a close-up view of a beam-mounted load transducer.
Figure 3:
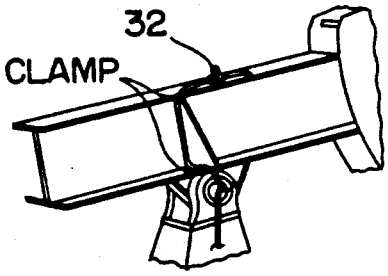

Alternatively, as illustrated in FIGS. 1 and 3 of the present application, load on polished rod 8 can be measured by mounting a load transducer 32 on the top flange of the walking beam 34. See, e.g., U.S. Pat. No. 3,817,094 issued to Montgomery, et al., incorporated herein by reference. Polished rod 8 imposed a load on the walking beam—through carrier bar 14, polished rod clamp 16, and bridle 12—which causes the walking beam to bend slightly, thus elongating the top flange of the walking beam 34. Such a beam-mounted load transducer 32 measures the elongation of the top flange of the walking beam 34, which is proportional to the load on polished rod 8. If a strain gauge is used, it may be desireable to provide a means for compensating for differential solar heating between the top and bottom flanges of the walking beam. See, for example, our U.S. Pat. No. 4,583,915.

Besides measuring load, it is also necessary to determine the relative coincident position of the polished rod 8, for example, by using a measurement that is proportional to the polished rod position at any time from a known event in the pumping cycle. The angle of walking beam 38 may be measured by connecting the body of a position transducer or potentiometer 40 to the static structure of the pumping unit, for example to sampson post 42. Potentiometer 40 contains a shaft connected parallel to the walking beam through a shaft extension 44 and a chain 46. As the walking beam rotates through its pumping arc, shaft extension 44, and thus the internal wiper in potentiometer 40, is rotated through the same angle as the walking beam. The position of the potentiometer wiper is thus proportional to the position of polished rod 8.

Alternatively, an inclinometer 48 may be mounted on the top flange of the walking beam 34, which produces an electronic signal proportional to the angle 38 of the walking beam and thus to the position of polished rod 8. See, e.g., U.S. Pat. No. 4,561,299, issued to Orlando, et. al., incorporated herein by reference.

Yet another means of determining position is to mount a position switch 50 to the static structure of the pumping unit in such a way as to allow detection of the passage of crank arm 52, giving an inferred indication of the position of polished rod 8 at one point in each pumping stroke. Because the motion of polished rod 8 is generally sinusoidal and the period of the stroke is known, a good representation of the polished rod position is possible through analysis of the period of the stroke, the geometry of the pumping unit, and the slip in the prime mover, motor 54.

The output signal of a potentiometer or inclinometer becoming greater than a predetermined value may also be used as a switch for detecting the position of the walking beam at a single point in the upstroke. Another means for determining the position of polished rod 8 is to mount a mercury switch to the walking beam in such a way that the mercury within the mercury switch will make an electrical connection at a particular point in the upstroke.

The units selected to measure load and position are connected via transducer cables 56 to controller 58. Controller 58 analyzes the load and position data and determines pump-off.

Figure 5:
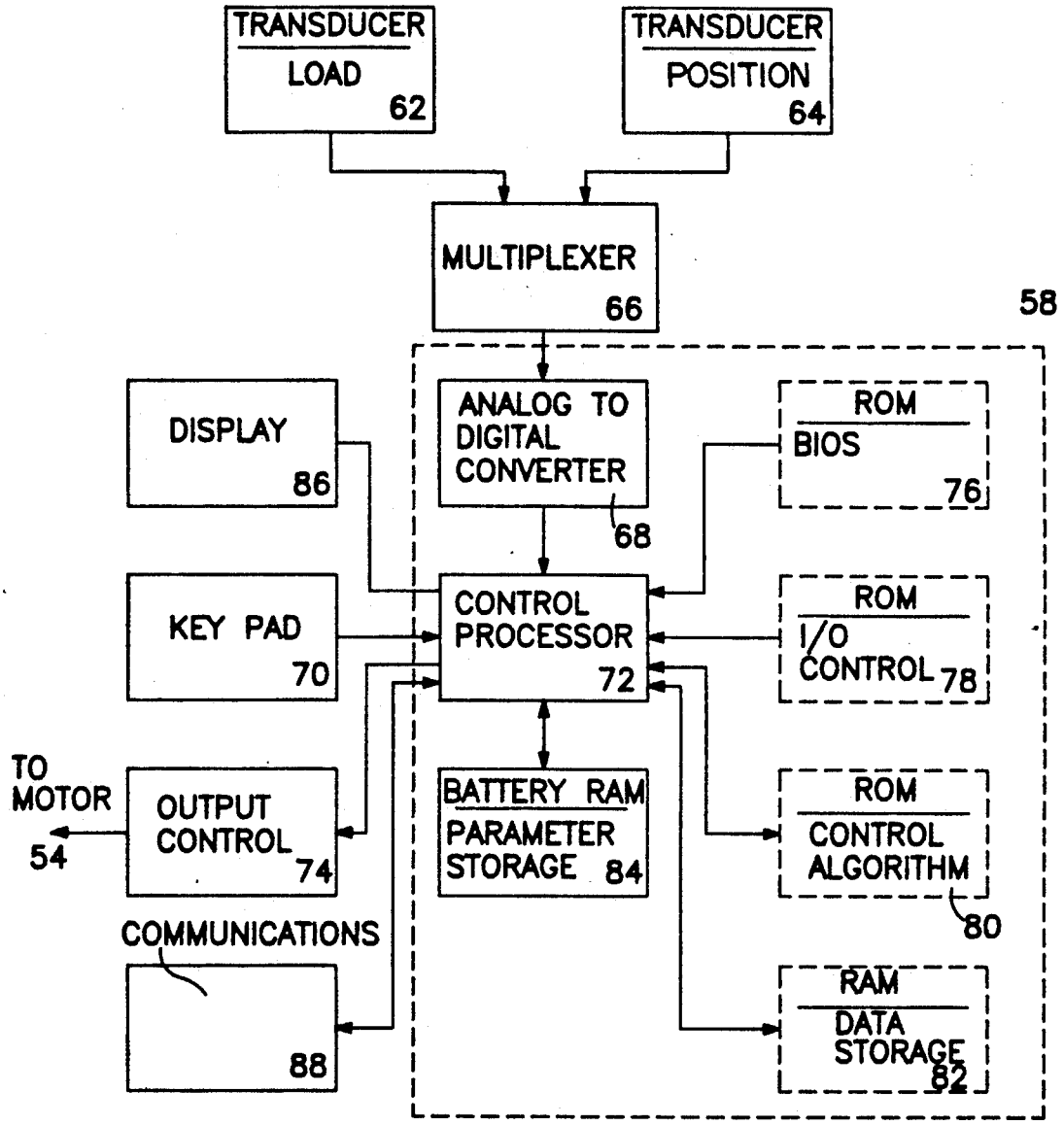
FIG. 5 shows a conceptual block diagram of the computer hardware and software, used in the pump controller.

FIG. 5 shows a system block diagram of the hardware and software within controller 58, including its inputs and outputs. Load-transducer signals 62 and position-transducer signals 64 pass to a multiplexer 66, which in turn passes the signals to an analog-to-digital converter 68, which may be within controller 58, and which translates the data into digital form for use by control processor 72. Control processor 72 may be an off-the-shelf microcontroller integrated circuit such as those manufactured by the Intel Corp. in the 8051 family. Controller 58 may be controlled by a user entering commands at an external keypad 70 or through a communications port 88. A major function of control processor 72 is to provide a control signal to output control 74 to stop motor 54 (or otherwise transfer control) when a condition, such as pump-off exists, and to send signals instructing a re-start of motor 54 at the appropriate time.

The basic operating system 76, the communications control program 78, and the pump-off detection algorithm 80 for the system are preferably maintained in read-only memory ("ROM"). Operating parameters, the operating program, and volatile data, such as dynagraph data, are preferably stored in random access memory ("RAM") 82. Historic data and a master copy of operating parameters are preferably stored in battery backed-up non-volatile random access memory ("BRAM") 84. When the power is turned on, the operating programs 76, 78, and 80 are downloaded from ROM to RAM 82, and the operating parameters are downloaded from BRAM 84 to RAM 82. The controller 72 is programmed, on command from the keypad 70 or communications port 88, to write messages containing the description and value for any parameter to a display 86.

Figure 6:
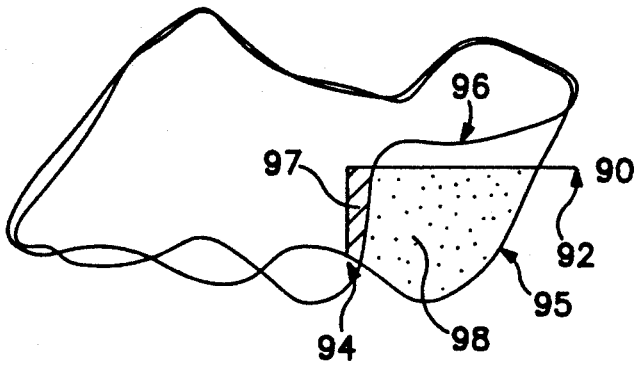
FIG. 6 shows examples of full and pumped-off dynagraph cards with integrated areas.

FIG. 6 illustrates example shapes of full-pump and pumped-off dynagraphs, shown using unconverted surface data. The horizontal axis in FIG. 6 represents position (up or down) relative to ground level, while the vertical axis represents load. As the pump proceeds through its cycle, the load-position point moves in a clockwise direction around the dynagraph. Line 90 represents a load reference, and the controller will integrate the area between Line 90 and the dynagraph data. Load reference 90 may be selected by the user, either (a) as an absolute load value, (b) as a relative value keyed to, for example, the maximum, minimum, or average load (or any combination of those, such as the difference between maximum and minimum) over a particular calibration stroke or the current stroke, or (c) as a value defined by the load at a particular time or position in a calibration or the current stroke, such as the load at the top of that stroke. Alternatively, load reference 90 may be set automatically by the controller, in any of a variety of ways. Some automatic methods may include dynamic calibration of load reference 90, in which it is set at a different level during each stroke, depending on actual measured load values.

The controller integrates the area below load reference 90 and between position limits 92 and 94. Position limit 92 represents the point at which the integration begins, and is normally set to approximate the top of the stroke. Position limit 92 may be determined in several ways, including a signal from a switch physically located at the top of the stroke, a program or circuitry that implements a mathematical MAX function, or a timer measuring a fixed or variable period from a known point in the upstroke. Under one implementation of the timer method, when installing the controller, the user places somewhere on the immovable supporting structure a circuit that detects the passage of the movable surface pumping equipment at a particular point in the upstroke, perhaps with the assistance of a companion device on the movable part. Then, the controller permits the user to select and input a timer period measured in fractions of seconds or perhaps in fraction of the stroke period. During operation, the controller starts the timer when the movable part passes the detector. When the timer expires, the integration begins. The controller might have the capability of timing the average stroke period, in which case the user might be permitted to set up the controller's timer to expire some user-selected fraction of that stroke period after the detector is triggered. That added capability permits more accurate detection of the top of the stroke regardless of variations in pumping speed, which might be considerable.

It is not necessary to the system that the integration-start reference, position limit 92, exactly match the top of the stroke. The user may wish to set the timer such that it expires part-way into the downstroke. However, it is normally undesirable for the limit to be set to precede the top of the stroke. The inventive system is designed to measure a portion of the area inside the dynagraph plot. Under normal integration methods, if the integration begins before the top of the stroke, or if load reference 90 is set too great, then the calculation of the area between load reference 90 and the dynagraph data will be contaminated by including an area which lies outside the dynagraph plot. The controller prevents that problem by accumulating in the integral any particular area only if load at the integration reference 90 exceeds the actual measured load data, that is, if the area is positive, even between position limits 92 and 94. In other words, the controller does not count integration values when the measured load value is greater than the integration reference value 90. Thus, it would not matter if the position limit 92 is set before the top of the stroke.

Therefore, in accordance with the broad concept of the invention, which is to integrate the area bounded by the integration reference 90, the end integration reference 94, and the dynagraph curve, it is not necessary to use a start integration reference 92. Rather, the controller may simply be set to begin calculating the area after the measured load value passes below the integration reference line 90. Thus, in a basic form of the invention, the step of and means for setting the begin of the integration period 92 can be omitted, and integration can begin as the dynagraph passes through the integration load reference value.

Position limit 94 represents the point at which the integration ends, and it may be set by the user, or determined automatically by the controller, including in the same ways described above in reference to position limit 92. Alternatively, the controller may be configured to permit the user to select the integration-end reference a fixed distance, time, or portion of stroke period after the integration-start reference.

FIG. 6 includes two superimposed example dynagraphs, one 95 representing a full-pump condition, and the other 96 representing a pumped-off condition. The small area 97 with hatch marks represents the area integrated as the well operates in a pumped-off condition. The shaded area 98 illustrates the additional area integrated as the well operates with a full pump.

FIG. 6 illustrates the principle that the integrated area is much smaller for a pumped-off well (area 97) than for a well in a full-pump condition (area 97 plus area 98). Referring additionally to FIG. 4, a normally operating pump immediately transfers load on the downstroke from travelling valve 24 to standing valve 26. In a pumped-off situation, however, the pump moves downwards rapidly through vapor before contacting the fluid-vapor interface, which delays travelling valve 24 from opening. That change in position without decrease in load may be seen in the pumped-off dynagraph 96 in FIG. 6 as a near-horizontal line moving to the left, above the integration reference line, beginning near the right edge of the diagram at the place indicated by the numeral 96.

Also, the overall area of the pumped-off dynagraph 96 in FIG. 6 is less than the area of the full-pump dynagraph 95, representing the truism that a pumped-off well accomplishes less work. That decrease in overall area, however, is not as easy to notice as the decrease in the partial area bounded by the limits described above, namely, integration reference 90, end integration reference 94, and the actual dynagraph curve between those references. The present methods, therefore, are much more sensitive to pump-off than prior methods.

In addition, alternative methods suffer from false detection of pump-off upon restart after shutdown for an extended time period. During shutdown, fluid level rises in the annuls. Upon restart, the hydrostatic head will be lower and the pump may not accomplish much work for a time, causing false detection of pump-off using typical area methods. The present method prevents that occurrence by considering only the partial area described above. If high fluid level causes the amount of work to decrease even though the pump is full, the dynagraph will shrink in overall size, but the lower righthand portion being integrated will not shrink considerably. If the well is actually pumped off, however, that integrated portion will shrink noticeably.

Figure 7:
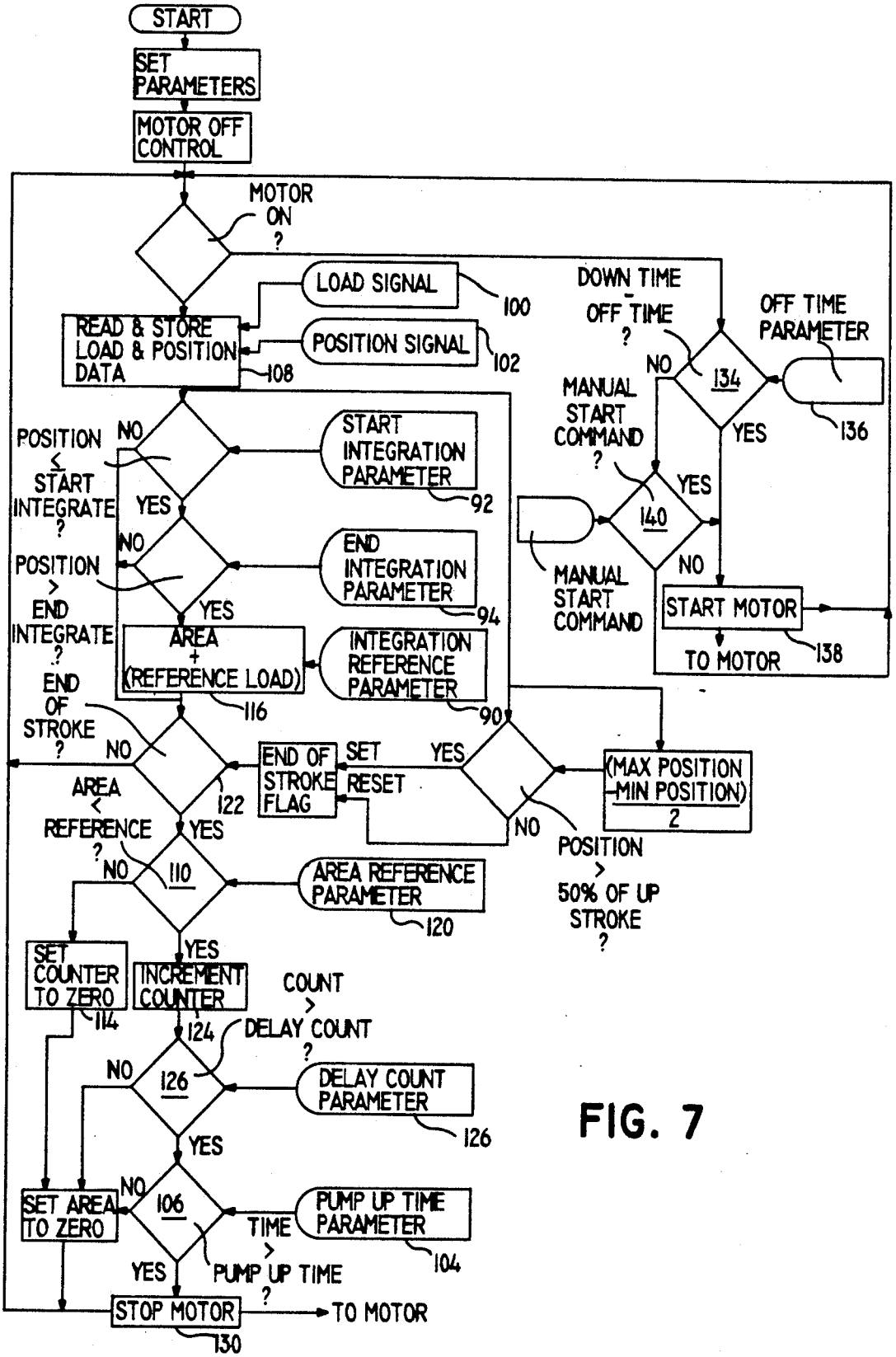
FIG. 7 shows a general logic flowchart for a preferred embodiment of the invention.

FIG. 7 illustrates a general logic flowchart for one embodiment of the invention. The flowchart shows an example control algorithm that may be recorded in ROM 80 in FIG. 5. When the pump motor is started up, the controller 58 begins receiving data for each stroke 108, including load data 100 (received from load transducers 30 or 32 in FIG. 1) and position data 102 (received from position transducer or switch 40 or 50 in FIG. 1).

For each stroke, employing the user-input limits 90, 92, and 94, the controller calculates the partial area described above. The controller calculates that integral according to the following method: When the position signal 102 is numerically equal to or less than (i.e., has passed below) the start of integration parameter 92, and is numerically greater than (i.e., has not passed below) the end of integration parameter 94, the load reading 100 is subtracted from the integration reference parameter 90, and the difference is added to the contents of a previously zeroed area register 116. As discussed above, if the actual load value is greater than the integration reference parameter 90, as is the case for a portion of the pumped-off dynagraph shown in FIG. 6, the calculated load difference value is set to zero, and has no impact on the area register 116. Also, although it would not alter the result of the calculation in the case shown in FIG. 7, the controller can be programmed to begin integrating the area and adding it to the area register 116 only after the dynagraph curve has passed through the integration reference 90. When the position signal 102 is numerically less than (i.e., has passed below) the end of integration parameter 94, and the controller detects the predefined end of stroke 122, then the controller compares 118 the calculated partial integral to a stored reference parameter 120. The reference parameter 120 should be set to tolerate some normal data variation without the controller declaring pump-off. In FIG. 7, the reference 120 is user-set, but it could be a percentage-reduced area from the last pump-up stroke, from the stroke before the current one, or a moving average of a certain number of previous strokes.

If the calculated partial area for the current stroke exceeds the reference area, the controller sets a delay counter and the area register to zero, see 110 and 114. Otherwise, the controller advances a delay counter 124, which is designed to permit the user to have the controller declare a pump-off fault only if the controller detects a pumped-off the condition on a user-set number of consecutive strokes 126. Alternative delay counters can be imagined, for example one that declares pump-off if a certain percentage of the last number of strokes are pumped-off. Another example would use a moving average of the areas from the last number of strokes and compare that value with the reference. The user could select the above-referenced percentages and numbers, or they could be set automatically.

If the delay counter does not equal the user-set limit, see 128, then the controller zeros the saved area and waits for data to arrive for the next stroke. Otherwise, the controller checks to see if a pump-up time has expired, see 106, and, if so, takes appropriate control action. In FIG. 7 that control action consists of issuing a command 130 to stop the motor and start a "down" timer that delays 134 for a user-input downtime 136 and then sends a signal 138 to restart the motor. The downtime may be pre-programmed instead of user-selected, and the controller may have the capability of altering the downtime based on the measured data. For example, the controller could save the previous and current runtime (i.e., the time between start-up and shutdown) and alter the downtime by adding (or subtracting) a fixed period, e.g., one minute, if the current runtime is shorter (or longer) by at least ten percent (or some other value) than the previous runtime. Other different control actions are possible, too, including sending a signal to a central location, displaying a message on a screen or display, shutting off the motor until it is serviced, setting an alarm, or doing nothing. The controller can also be programmed to slow down the motor, to pump the fluid more slowly. Alternatively, a combination of those control actions might be selected. The controller may be configured to permit the user to select and alter the control action, or the control action may be pre-programmed. The user may send an manual start command 140.

The controller delays taking any control action for a user-input "pump-up" time 104, which may be a fixed time period or a certain number of strokes (if the controller is configured to measure the stroke period). Directly after start-up, pump barrel 20 and tubing 22 (in FIG. 4) may not be full of fluid, and the work done by the pump and the load on the rod string may fluctuate erratically or begin at unusually low values. The delay 106 is designed to permit the pumping action to stabilize somewhat before the controller begins considering well shutdown.

Although the preferred embodiments have been described above, other types or variants of the above system should be employed. Furthermore, numerous forms of programming can be used to carry out the specific command and control of the computer. For example, it is envisioned that state-machine programming could be employed. Also, the algorithms for fault recognition could be implemented in a dedicated integrated circuit, for example, using microcode or programmed logic arrays, rather than in a computer program. Thus, it will be understood by those skilled in the art that numerous alternate forms and embodiments of the invention can be devised without departing from its spirit and scope.

I claim:

1. An apparatus for controlling a well pumping system having a prime mover connected by a sucker-rod string to a reciprocated subterranean pump, comprising:

(a) load measuring means for determining load values representing the load on the sucker-rod string as the pump is reciprocated through its pumping cycle;

(b) position measuring means for determining position values corresponding to the position of the sucker-rod string as the pump is reciprocated through its pumping cycle;

(c) means for setting a load reference at a value greater than at least some of the load values determined in the downstroke of the pumping cycle, a first position reference value in the downstroke, and a second position reference value later in the downstroke;

(d) computing means for determining the area bounded above by the load reference value, starting at the first position reference value, ending at the second position reference value, and bounded below by the determined load and position values;

(e) means for setting an area reference value;

(f) comparison means for comparing the determined area to the area reference value; and (g) control means for altering the operating parameters of the well system based on the comparison of the determined area to the area reference value.

2. The apparatus of claim 1 wherein the comparison means includes means for determining if the determined area is less than the reference area.

3. The apparatus of claim 1 wherein the control means includes means for shutting off the prime mover for at least a period of time.

4. The apparatus of claim 1 wherein the control means includes means for slowing down the prime mover.

5. The apparatus of claim 1 wherein the control means includes means for altering the operating parameters of the well system based on the comparison of the determined area to the reference area over a plurality of strokes.

6. The apparatus of claim 1 wherein the load measuring means includes a load transducer operatively disposed between the sucker-rod string and the prime mover.

7. The apparatus of claim 1 wherein the load measuring means includes a load transducer mounted on a lifting beam.

8. The apparatus of claim 1 wherein the position measuring means includes a potentiometer in contact with a lifting beam.

9. The apparatus of claim 1 wherein the position measuring means includes an inclinometer mounted on a lifting beam.

10. The apparatus of claim 1 wherein the computing means includes means for determining when at least one element of the above-ground pumping system passes a fixed position during a particular stroke and for beginning the area determination at a measured time thereafter.

11. The apparatus of claim 10 wherein the position measuring means includes a switch that indicates the passage of at least one element of the above-ground pumping system by a fixed position in the upstroke.

12. The apparatus of claim 1 wherein the computing means includes means for generating a dynagraph representing the determined load and position values of the sucker-rod string while the pumping system is passing through at least one complete pumping cycle.

13. The apparatus of claim 12 further comprising dynagraph display means for displaying the generated dynagraph plot during the pumping cycle.

14. An apparatus for controlling a well pumping system having a prime mover connected by a sucker-rod string to a reciprocated subterranean pump, comprising:

(a) load measuring means for generating, at a series of measuring times as the pump is reciprocated through its pumping cycle, a signal proportional to the relative load on the sucker-rod string;

(b) position measuring means for generating a signal proportional to the position of the sucker-rod string in the pumping cycle contemporaneous to each load signal;

(c) means for setting an integration-end time in the downstroke of the pumping cycle, an integration-start time, and a load reference at a value greater than at least some of the load values determined in the downstroke of the pumping cycle;

(d) integration means for accumulating the positive differences between the load reference value and the load value determined from the signal generated by the load measuring means, for each measuring time during the time period between the set integration-start time and the set integration-end time;

(e) means for setting an area reference value;

(f) comparison means for comparing the determined area to the set area reference value; and (g) control means for altering the operating parameters of the well system based on the comparison of the determined area to the area reference value.

15. An apparatus for controlling a well pumping system having a prime mover connected by a sucker-rod string to a reciprocated subterranean pump, comprising:

(a) load measuring means for determining load values representing the load on the sucker-rod string as the pump is reciprocated through its pumping cycle;

(b) position measuring means for determining position values corresponding to the position of the sucker-rod string as the pump is reciprocated through its pumping cycle and including a switch that indicates the passage of at least one element of the above-ground pumping system past a fixed position in the pumping cycle;

(c) means for setting:

(i) a load reference at a value greater than at least some of the load values determined in the downstroke of the pumping cycle, (ii) a first position reference value representing the position of the sucker-rod string at a first selected time after the element passes the fixed position, and (iii) a second position reference value representing the position of the sucker-rod string in the downstroke at a second selected time thereafter;

(d) computing means for determining the area bounded above by the load reference value, starting at the first position reference value, ending at the second position reference value, and bounded below by the determined load and position values;

(e) means for generating a dynagraph representing the determined load and position values of the sucker-rod string during a complete pumping cycle;

(f) means for setting an area reference value;

(g) comparison means for determining if the determined area is less than the reference area; and (h) control means for shutting off the prime mover for at least a period of time based on the comparison of the determined area to the reference area over a plurality of strokes.

16. A method for controlling a well pumping system having a prime mover connected by a sucker-rod string to a reciprocated subterranean pump, comprising:

(a) determining load values representing the load on the sucker-rod string as the pump is reciprocated through its pumping cycle;

(b) determining position values corresponding to the position of the sucker-rod string as the pump is reciprocated through its pumping cycle;

(c) setting a load reference at a value greater than at least some of the load values determined in the downstroke of the pumping cycle;

(d) setting a begin position reference value and an end position reference value in the downstroke of the pumping cycle;

(e) determining the area bounded above by the load reference value, starting at the begin position reference value, ending at the end position reference value, and bounded below by the determined load and position values;

(f) setting an area reference value;

(g) comparing the determined area to the area reference value; and (h) altering the operating parameters of the well system based on the comparison of the determined area to the area reference value.

17. The method of claim 16 wherein the step of determining the area includes determining when at least one element of the above-ground pumping system passes a fixed position during a particular stroke and beginning the area calculation at a measured time thereafter.

18. The method of claim 16 wherein the comparing step includes determining if the determined area is less than the reference area.

19. The method of claim 16 wherein the step of altering the operating parameters includes shutting off the prime mover for at least a period of time.

20. The method of claim 16 wherein the step of altering the operating parameters includes slowing down the prime mover.

21. The method of claim 16 wherein the step of altering the operating parameters is based on comparing the determined area to the reference area over a plurality of strokes.

22. The method of claim 16 further comprising the step of constructing a dynagraph representing a plot of load versus position of the sucker-rod string while the pumping system is passing through at least one complete pumping cycle.

23. The method of claim 22 wherein:

(a) the step of determining the area includes determining when at least one element of the above-ground pumping system passes a fixed position during a particular stroke and beginning the area calculation a measured time thereafter;

(b) the comparing step includes determining if the determined area is less than the reference area; and (c) the step of altering the operating parameters includes shutting off the prime mover for at least a period of time if the determined area is less than the reference area during a plurality of strokes.

24. The method of claim 22 further comprising the step of displaying the constructed dynagraph plot during the pumping cycle.

* * * * *